US010694281B1

(12) United States Patent
Zastoupil et al.

(10) Patent No.: US 10,694,281 B1
(45) Date of Patent: Jun. 23, 2020

(54) COAXIAL WAVEGUIDE

(71) Applicant: Bose Corporation, Framingham, MA (US)

(72) Inventors: Greg Joseph Zastoupil, North Grafton, MA (US); Joseph J. Kutil, III, Franklin, MA (US); Gabriel Lloyd Murray, Shrewsbury, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/205,388

(22) Filed: Nov. 30, 2018

(51) Int. Cl.
*H04R 1/28* (2006.01)
*H04R 1/24* (2006.01)

(52) U.S. Cl.
CPC ..... *H04R 1/2811* (2013.01); *H04R 1/24* (2013.01)

(58) Field of Classification Search
CPC ..... H04R 1/2811; H04R 1/24
See application file for complete search history.

(56) References Cited

U.S. PATENT DOCUMENTS 3,991,286 A * 11/1976 Henricksen ..... H04R 9/00 381/189
5,268,538 A * 12/1993 Queen ..... H04R 1/345 181/144
6,411,718 B1 6/2002 Danley et al.
8,259,981 B2 9/2012 Danley
8,422,712 B2 4/2013 Danley
8,457,341 B2 6/2013 Danley
8,488,826 B2 7/2013 Danley
8,607,922 B1 12/2013 Werner
8,842,867 B2 9/2014 Bothe
9,749,735 B1 8/2017 Silver et al.
10,034,081 B2 7/2018 Tipparaju et al.
2002/0014369 A1 2/2002 Engebretson
2009/0136072 A1* 5/2009 Danley ..... H04R 1/24 381/340
2009/0310808 A1 12/2009 Button et al.
2017/0311075 A1 10/2017 Vaisanen et al.
2018/0027321 A1* 1/2018 Jaguste ..... H04R 1/2834 381/59
2019/0090049 A1* 3/2019 Xie ..... H04R 1/345

FOREIGN PATENT DOCUMENTS

EP 0429121 5/1991

OTHER PUBLICATIONS

International Search Report and Written Opinion for Application No. PCT/US2019/063042, dated Mar. 12, 2020, 13 pages.

* cited by examiner

*Primary Examiner* — Regina N Holder
(74) *Attorney, Agent, or Firm* — Hoffman Warnick LLC

(57) ABSTRACT

Various implementations include loudspeakers. In some particular cases, a loudspeaker includes: a high frequency (HF) driver; a low frequency (LF) driver coaxially arranged with the HF driver; and a waveguide overlying a sound radiating surface of the LF driver, the waveguide having a hole pattern such that a sound radiation pattern of the LF driver matches a sound radiation pattern of the HF driver at a reference location.

20 Claims, 6 Drawing Sheets

COAXIAL WAVEGUIDE

TECHNICAL FIELD

This disclosure generally relates to loudspeakers. More particularly, the disclosure relates to a loudspeaker having a coaxial waveguide for controlling sound radiation patterns from low frequency and high frequency drivers.

BACKGROUND

There is an increasing demand for low-profile speaker applications. However, as the depth of a loudspeaker is decreased, the reduced distance between the low frequency driver (woofer) and the high frequency driver (tweeter) can create acoustic challenges. For example, the beamwidth of the low frequency driver can be difficult to control under these conditions. Conventional loudspeakers fail to address these challenges.

SUMMARY

All examples and features mentioned below can be combined in any technically possible way.

Various implementations include loudspeakers with a coaxial waveguide. In additional implementations, a coaxial waveguide is used to control an acoustic output of a loudspeaker.

In some particular aspects, a loudspeaker includes: a high frequency (HF) driver; a low frequency (LF) driver coaxially arranged with the HF driver; and a waveguide overlying a sound radiating surface of the LF driver, the waveguide having a hole pattern such that a sound radiation pattern of the LF driver matches a sound radiation pattern of the HF driver at a reference location.

In another aspect, a loudspeaker includes: a high frequency (HF) driver; a low frequency (LF) driver coaxially arranged with the HF driver; a waveguide overlying a sound radiating surface of the LF driver, the waveguide having a plate with a plurality of holes extending axially therethrough, where a sound radiation pattern of the LF driver matches a sound radiation pattern of the HF driver at a reference location; and batting located between the waveguide and the LF driver, where the batting controls cavity resonance between the LF driver and the waveguide.

In an additional aspect, a method includes: providing a loudspeaker having: a high frequency (HF) driver; a low frequency (LF) driver coaxially arranged with the HF driver; and a waveguide overlying a sound radiating surface of the LF driver; and converting an electrical signal to an acoustic output at the loudspeaker, where the waveguide has a hole pattern such that the acoustic output comprises a sound radiation pattern of the LF driver that matches a sound radiation pattern of the HF driver at a reference location.

In a further aspect, a loudspeaker includes: a high frequency (HF) driver; a low frequency (LF) driver coaxially arranged with the HF driver; a waveguide overlying a sound radiating surface of the LF driver; an enclosure defining an acoustic volume in front of the LF driver; and a Helmholtz resonator coupled with the acoustic volume in front of the LF driver.

In another aspect, a loudspeaker includes: a high frequency (HF) driver; a low frequency (LF) driver coaxially arranged with the HF driver; a waveguide overlying a sound radiating surface of the LF driver; a housing defining an acoustic backvolume between the LF driver and the HF driver; and a Helmholtz resonator coupled with the acoustic backvolume between the LF driver and the HF driver.

Implementations may include one of the following features, or any combination thereof.

In some cases, the waveguide includes an aperture through which the HF driver is exposed.

In particular aspects, the loudspeaker further includes batting located between the waveguide and the LF driver, where the batting controls cavity resonance between the LF driver and the waveguide, and where the batting is acoustically transparent at low frequencies and acts as a rigid acoustic boundary at high frequencies.

In certain implementations, the waveguide is located in front of the LF driver.

In some aspects, the waveguide includes a rigid baffle surrounding the HF driver and defining the hole pattern.

In particular cases, the hole pattern includes a plurality of holes arranged around the HF driver.

In certain aspects, energy from the LF driver is vented through holes in the hole pattern to control a beamwidth of an acoustic output.

In some cases, the waveguide includes a material for dissipating heat from the HF driver.

In particular implementations, the loudspeaker further includes: an enclosure defining an acoustic volume in front of the LF driver; and a Helmholtz resonator coupled with the acoustic volume in front of the LF driver.

In some cases, the loudspeaker includes acoustic batting in the Helmholtz resonator coupled with the acoustic volume in front of the LF driver.

In certain implementations, the loudspeaker further includes: a housing defining an acoustic backvolume between the LF driver and the HF driver; and a Helmholtz resonator coupled with the acoustic volume in front of the LF driver. The Helmholtz resonator can be located within the acoustic backvolume between the LF driver and the HF driver.

In some aspects, the loudspeaker includes acoustic batting in the acoustic backvolume between the LF driver and the HF driver.

In particular cases, energy from the LF driver is vented through holes in the hole pattern to control a beamwidth of the acoustic output, where the loudspeaker further comprises batting located between the waveguide and the LF driver, where the batting controls cavity resonance between the LF driver and the waveguide, and the batting is acoustically transparent at low frequencies and acts as a rigid acoustic boundary at high frequencies.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
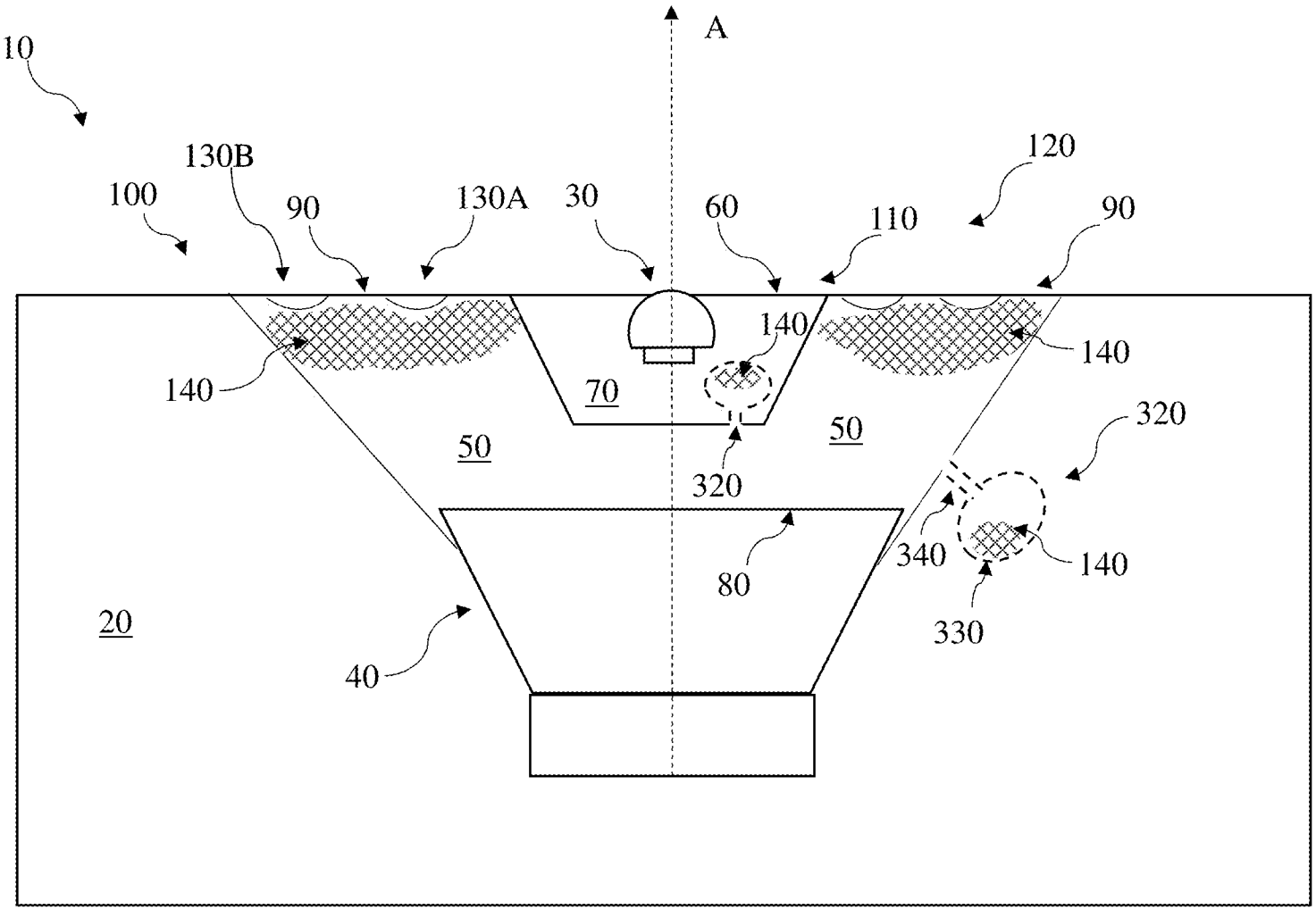
FIG. 1 shows a side cross-sectional view of a loudspeaker according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a coaxial waveguide can be beneficially incorporated into a loudspeaker. For example, a loudspeaker having a coaxial waveguide can provide a desired acoustic output in flush-mounted or surface-mounted applications.

Commonly labeled components in the FIGURES are considered to be substantially equivalent components for the purposes of illustration, and redundant discussion of those components is omitted for clarity.

As described herein, low-profile speaker systems create system design challenges due to their reduced spacing between the high frequency (HF) driver (or, tweeter) and the low frequency (LF) driver (or, woofer). Because many end user applications demand flush-mounted or surface-mounted speaker designs, loudspeaker system designers must attempt to provide desired acoustic outputs with reduced spacing between the HF driver and the LF driver. Conventional approaches for addressing this issue fail to control beamwidth at low frequencies, exhibit cavity resonance, and/or exhibit inconsistent off-axis acoustic output.

In contrast to conventional systems, the loudspeakers disclosed according to various implementations include an LF driver that is coaxially arranged with an HF driver. The loudspeakers include a waveguide with a hole pattern for controlling the sound radiation pattern of the LF driver to match the sound radiation pattern of the HF driver at a reference location in front of the loudspeaker. In certain cases, the sound radiation pattern for the loudspeaker can be defined by its beamwidth. The loudspeakers disclosed according to various implementations can provide consistent off-axis acoustic output, for example, at various distances peripheral to the central axis of the HF and LF driver. The integrated waveguide configuration can improve consistency in the acoustic output across a wide range of frequencies (e.g., from the low-frequency cut-off of the LF driver to the crossover frequency where the HF driver controls the speaker response). Additionally, the loudspeakers disclosed according to various implementations can include acoustic batting for controlling cavity resonance between the LF and HF drivers. In some cases, the waveguide can also act as a heat sink to cool the HF driver, allowing for higher power applications with a higher sound pressure level (SPL) when compared with conventional systems.

Figure 2:
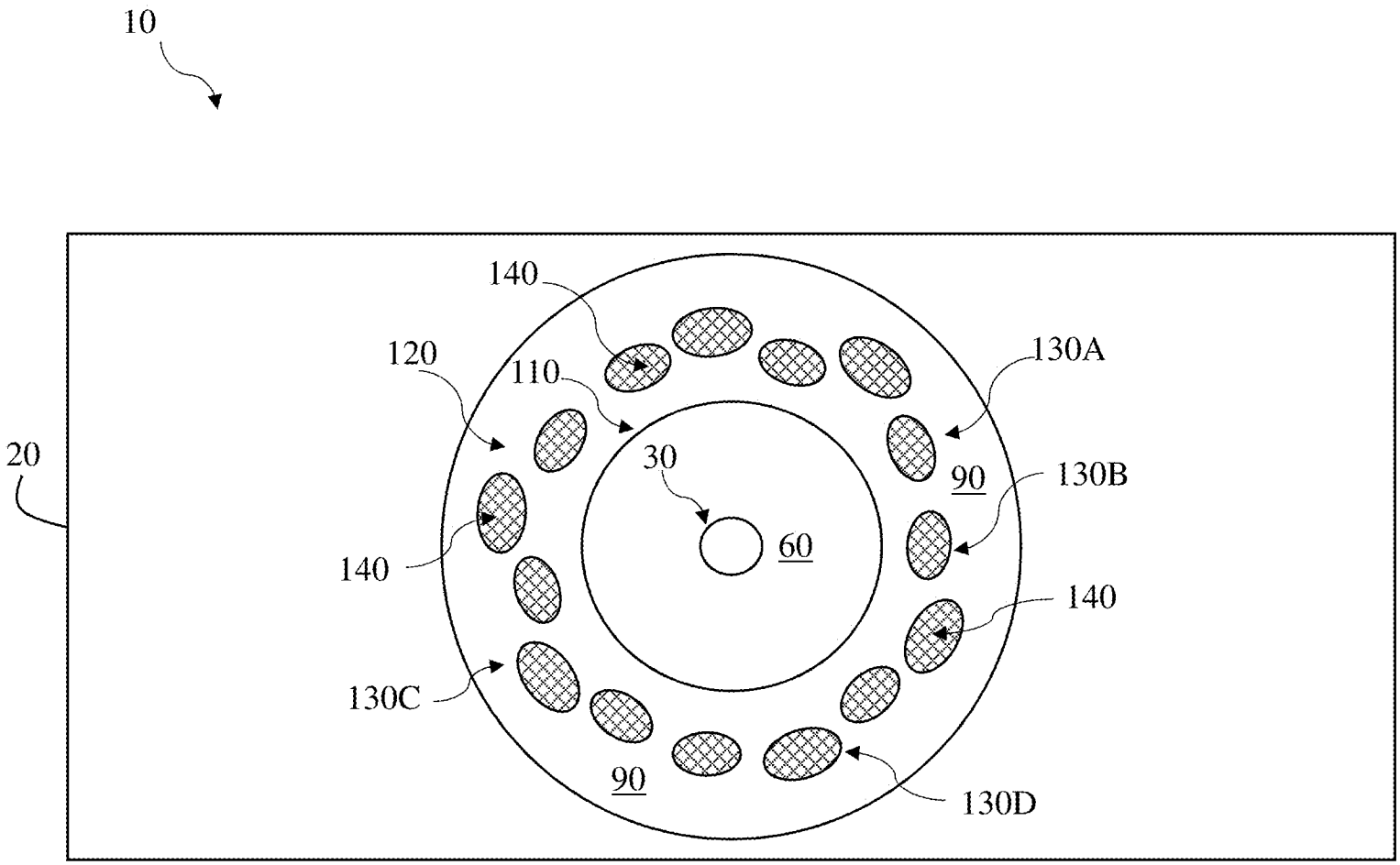
FIG. 2 shows a top sectional view of the loudspeaker of FIG. 1.

FIG. 1 shows a side cross-sectional view, and FIG. 2 shows a plan sectional view, of a loudspeaker 10 according to various implementations. FIGS. 1 and 2 are referred to simultaneously. According to various implementations, the loudspeaker 10 includes an enclosure 20 housing a high frequency (HF) driver 30 and a low frequency (LF) driver 40. In some cases, the HF driver 30 includes a tweeter, such as a dome tweeter, cone tweeter, piezo tweeter, etc. In one particular implementation, the HF driver 30 is a dome tweeter. In certain implementations, the LF driver 40 includes a woofer. In some implementations, the LF driver 40 is arranged coaxially with the HF driver 30, such that the central axis of motion of the LF driver 40 coincides with the central axis of motion of the HF driver 30, as indicated by axis (A) in FIG. 1. However, in other implementations, the central axis of the HF driver 30 can be angled/rotated with respect to axis (A), such that the output of the loudspeaker 10 is asymmetric.

It is understood that both the HF driver 30 and the LF driver 40 can be coupled with one or more control circuits (not depicted) for providing electrical signals to excite one or both of the drivers 30, 40. Each driver 30, 40 includes a sound-radiating surface for producing an acoustic output. The control circuit(s) can include a processor and/or microcontroller, which can include decoders, DSP hardware/software, etc. for playing back (rendering) audio content at one or both of the HF driver 30 or the LF driver 40. The control circuit(s) can also include one or more digital-to-analog (D/A) converters for converting the digital audio signal to an analog audio signal. This audio hardware can also include one or more amplifiers which provide amplified analog audio signals to the HF driver 30 and/or the LF driver 40.

The enclosure 20 defines an acoustic volume 50 in front of the LF driver 40, which responds to motion of the LF driver 40 when the LF driver 40 is excited by an electrical signal. The loudspeaker 10 also includes a housing 60 defining an acoustic backvolume 70 that is located between the LF driver 40 and the HF driver 30. In some cases, the acoustic backvolume 70 responds to motion of the HF driver 30 when that driver is excited by an electrical signal. In other implementations, the HF driver 30 may include a separate backvolume that is sealed to its transducer, such that the HF driver 30 does not interact with the acoustic backvolume 70. In any case, the enclosure 20 and the housing 60 can be formed of any conventional loudspeaker material, e.g., a heavy plastic, metal, composite material, etc.

Overlying a sound radiating surface 80 of the LF driver 40 is a waveguide 90 for directing acoustic energy from the LF driver 40 to the front 100 of the loudspeaker enclosure 20. In various implementations, the waveguide 90 includes at least one aperture 110 through which the HF driver 30 is exposed. That is, the waveguide 90 includes the aperture 110 to accommodate the HF driver 30, such that the HF driver 30 is exposed at the front 100 of the loudspeaker enclosure 20.

As shown in FIG. 1, the waveguide 90 is located in front of the LF driver 40. In various implementations, the waveguide 90 includes a hole pattern 120 including a plurality of holes 130 (shown as holes 130A, 130B, 130C, etc.) arranged around the HF driver 30. This arrangement of holes 130 is merely one example arrangement, and it is understood that a variety of hole positions and/or sizes can be used according to the various implementations. The holes 130 extend through the waveguide 90 to allow airflow between the acoustic volume 50 and the front 100 of the enclosure 20, i.e., to ambient. As described herein, in various implementations, the hole pattern 120 is configured such that a sound radiation pattern of the LF driver 40 matches a sound radiation pattern of the HF driver 30 at a reference location. In some examples, this reference location includes any location approximately ten (10) meters in front of the loudspeaker within a lateral distance defined by the coverage pattern, or beamwidth of the speaker 10. In certain examples, the beamwidth of the speaker 10 can range between approximately 130 degrees and approximately 150 degrees. That is, according to various implementations, energy from the LF driver 40 is vented through holes 130A, 130B, 130C, etc., in the hole pattern 120 of the waveguide 90 to control a beamwidth of an acoustic output from the loudspeaker 10.

In certain implementations, the waveguide 90 includes a rigid baffle that surrounds the HF driver 30 and defines the hole pattern 120. That is, in some examples, the hole pattern 120 can be configured such that a center-to-center spacing between the holes 130 as measured by a line intersecting the central axis (A) is approximately 2 inches to approximately 5 inches (and in some particular example cases, approximately 3.5 inches). It is understood that various holes 130 in the pattern may have distinct center-to-center spacing, and that these values are merely examples of particular implementations.

In various implementations, the waveguide 90 is formed of a material for dissipating heat from the HF driver 30. In some cases, the waveguide 90 includes a metal such as aluminum (or alloys of aluminum), however, in other cases, the waveguide 90 includes another material with sufficient thermal conductivity to aid in dissipating heat from the HF driver 30.

In certain particular cases, the loudspeaker 10 further includes batting 140 located in the acoustic volume 50 between the waveguide 90 and the LF driver 40. The batting 140 can include cotton or a synthetic fiber, and can be affixed (e.g., adhered or mounted) at the backside of the waveguide 90 or affixed to one or more walls of the enclosure 20 or the housing 60. In particular example implementations, as shown in FIG. 1, the batting 140 is affixed to the backside of the waveguide 90. In various implementations, the batting 140 can aid in controlling cavity resonance between the LF driver 40 and the waveguide 90. In cases where the batting 140 is affixed to the backside of the waveguide 90, the batting 140 can be acoustically transparent at low frequencies (e.g., frequencies below the crossover frequency for the LF driver 40), but can act as a rigid acoustic boundary at high frequencies (e.g., frequencies above the crossover frequency for the LF driver 40). Additionally, when the batting 140 is affixed to the backside of the waveguide 90, the batting 140 can dampen the cavity resonance in the acoustic volume 50 that occurs at frequencies near the crossover frequency (e.g., frequencies around 2 kilo Hertz (kHz)). That is, when the batting 140 is affixed to the backside of the waveguide 90, it can provide a smoother (less reverberant) on-axis response from the HF driver 30, as well as a more consistent off-axis response from the HF driver 30.

In other cases, as noted herein, the batting 140 is affixed to one or more walls of the enclosure 20 and/or the housing 60, either with or without batting 140 affixed to the backside of the waveguide 90. Batting in these additional locations can dampen resonances in the loudspeaker 10, but may not act as the rigid acoustic boundary at high frequencies.

In operation, the control circuit in loudspeaker 10 is configured to convert an electrical signal to an acoustic output at the HF driver 30 and the LF driver 40. As noted herein, the hole pattern 120 in the waveguide 90 is configured such that the acoustic output has a sound radiation pattern of the LF driver 40 that matches a sound radiation pattern of the HF driver 40 at the reference location. That is, energy from the LF driver 30 is vented through holes 130 in the hole pattern 120 to control a beamwidth of the acoustic output. In certain cases, the batting 140 is used to control cavity resonance in the acoustic volume 50 between the LF driver 40 and the waveguide 90, such that the batting 140 is acoustically transparent at low frequencies and acts as a rigid acoustic boundary at high frequencies.

Figure 3:
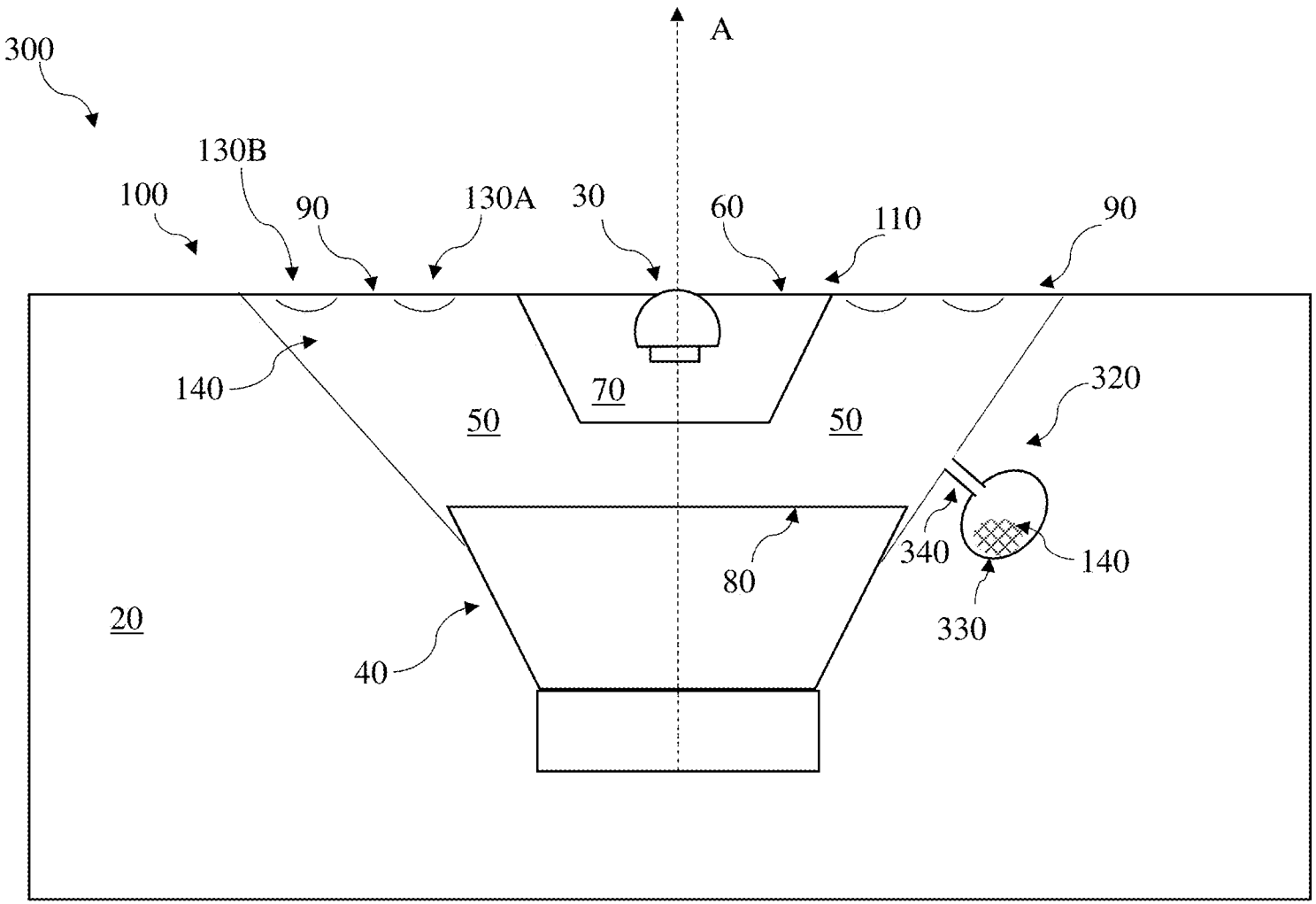
FIG. 3 shows a side cross-sectional view of a loudspeaker according to various additional implementations.

FIG. 3 shows a cross-sectional depiction of an additional implementation of a loudspeaker 300. As shown in FIG. 3, loudspeaker 300 can include a Helmholtz resonator 320 coupled with the acoustic volume 50 in front of the LF driver 40. In certain cases, the Helmholtz resonator 320 is located within the wall of the enclosure 20 proximate the LF driver 40. During operation of the loudspeaker 10, the Helmholtz resonator 320 can dampen cavity resonance in the acoustic cavity 50. In some implementations, the Helmholtz resonator 320 includes a pocket 330 of gas (e.g., air) that is coupled with the acoustic volume 50 by a narrowed neck section 340. In other example implementations, a portion of the pocket of the Helmholtz resonator 320 is filled with acoustic batting 140, which can control the Q factor of that Helmholtz resonator 320. The Q factor is a dimensionless parameter that indicates energy losses within a resonant element. The batting 140 can be affixed to an inner surface of the Helmholtz resonator 320 and can be used to match the Q factor of the Helmholtz resonator 320 with the Q factor for the acoustic volume 50 to which it is coupled.

Figure 4:
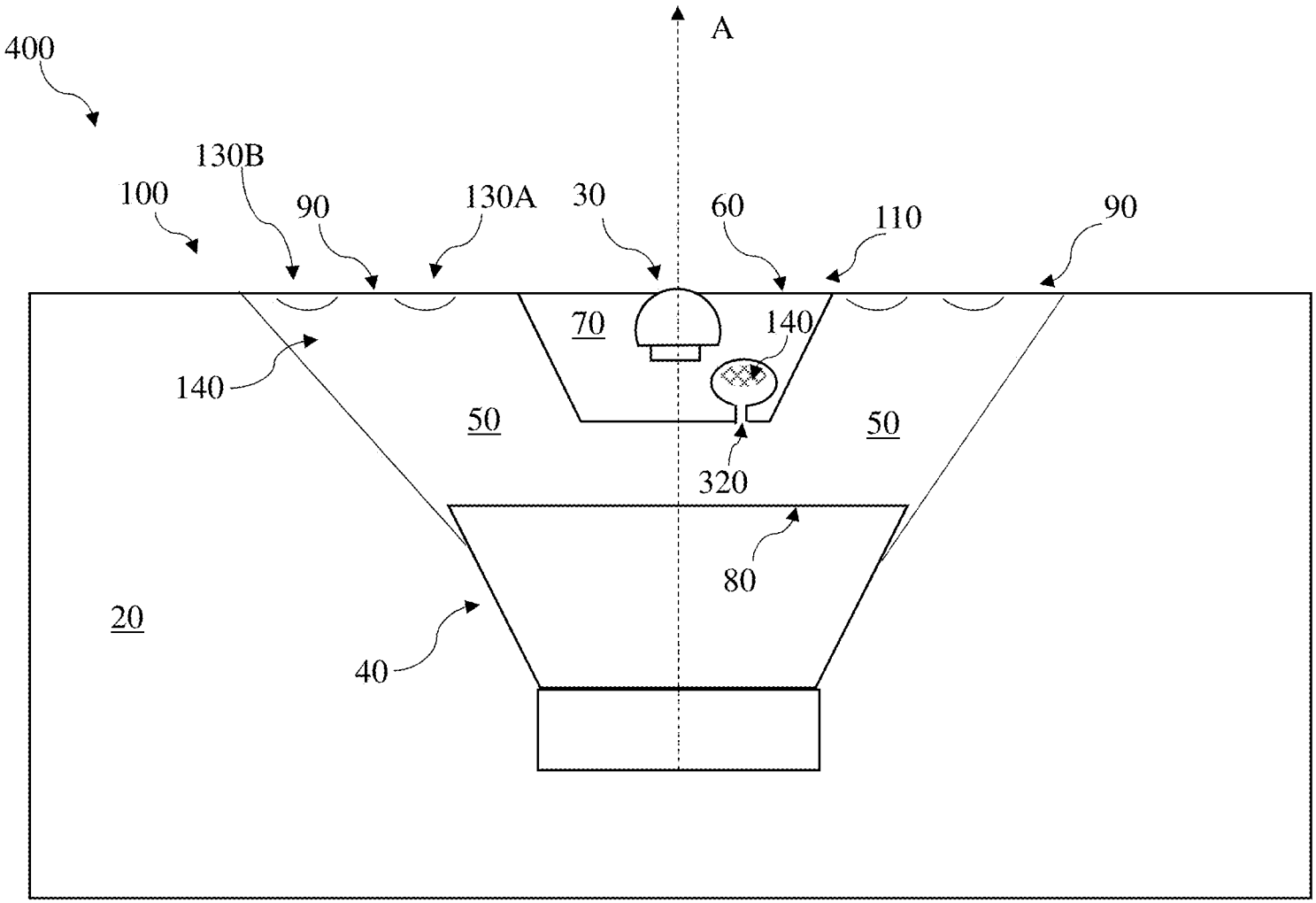
FIG. 4 shows a side cross-sectional view of a loudspeaker according to various further implementations.

FIG. 4 shows a cross-sectional depiction of an additional implementation of a loudspeaker 400. As shown in FIG. 4, the loudspeaker 400 can include a Helmholtz resonator 320 coupled with the acoustic volume 50 between the LF driver 40 and the HF driver 30. In certain cases, the Helmholtz resonator 320 is located within the wall of the housing 60 behind the HF driver 30. According to some implementations, the Helmholtz resonator 320 is located within the wall of the housing 60 in a location between the LF driver 40 and the HF driver 30, e.g., extending into the acoustic backvolume 70 between the LF driver 40 and the HF driver 30. The Helmholtz resonator 320, in some cases in combination with the acoustic batting 140, can be used to dampen cavity resonance in the acoustic volume 50. In some implementations, the Helmholtz resonator 320 includes a pocket of gas (e.g., air) that is coupled with the acoustic backvolume 70 by a narrowed neck section (not labeled in FIG. 4). In certain implementations, as discussed with reference to the Helmholtz resonator 320 in FIG. 3, a portion of the acoustic backvolume 70 is filled with acoustic batting 140.

Returning to FIG. 1, it is understood that the loudspeaker 10 can also include a Helmholtz resonator 320 in one of the locations shown and described with reference to FIGS. 3 and 4. These example implementations are illustrated in phantom, with a Helmholtz resonator 320 coupled to the acoustic volume 50 and located either in the wall of the enclosure 20 (similarly to the loudspeaker 300 in FIG. 3), or in the wall of the housing 60 (similarly to the loudspeaker 400 in FIG. 4).

Figure 5:
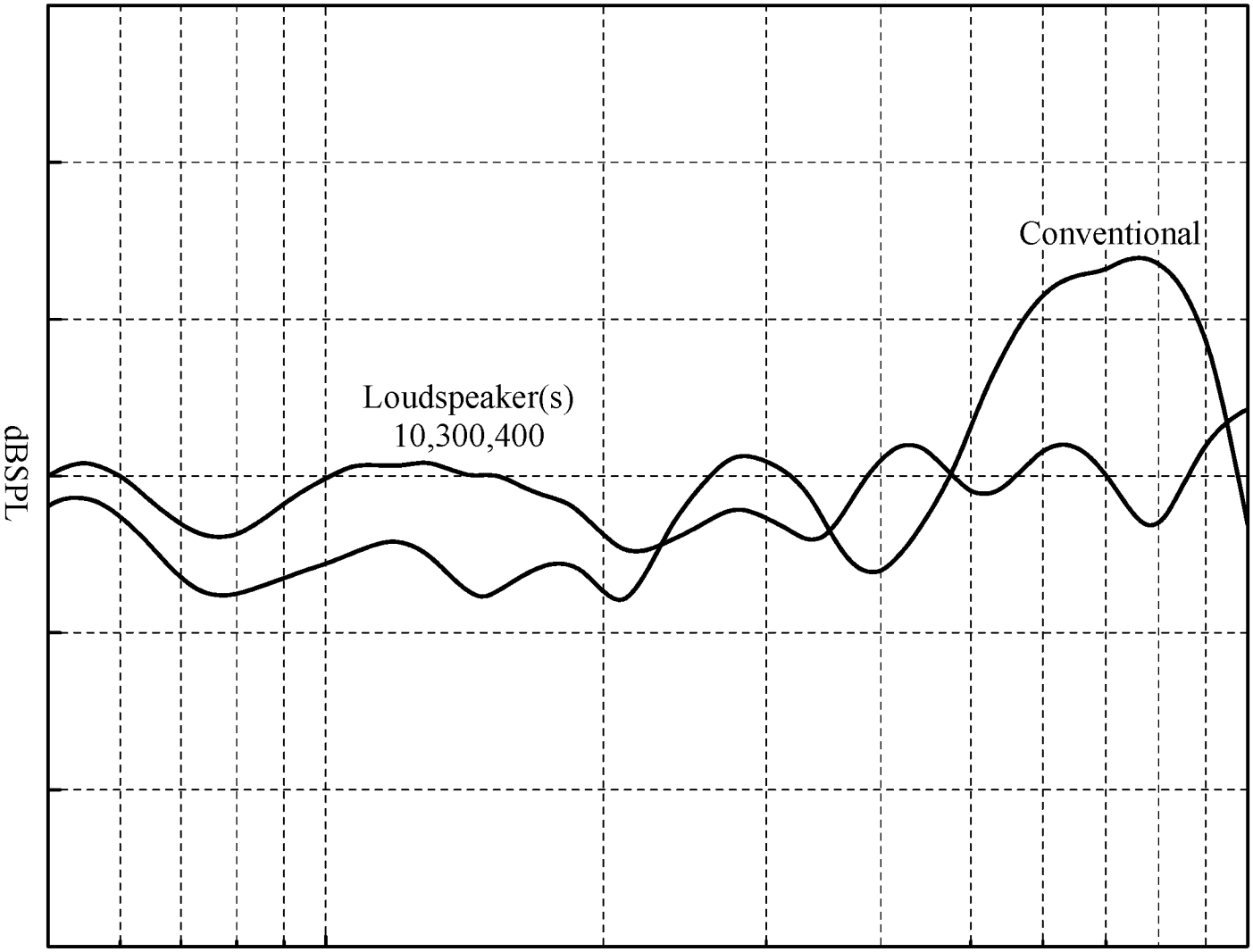
FIG. 5 shows an example frequency response graph illustrating sound pressure level (SPL) versus frequency for a loudspeaker according to various implementations as compared with a conventional loudspeaker.

FIG. 5 shows an example frequency response graph illustrating sound pressure level (SPL) versus frequency for a loudspeaker according to various implementations (e.g., loudspeaker 10, 300 or 400) and a conventional loudspeaker without the waveguide(s) described herein (e.g., waveguide 90 or waveguide 310). FIG. 5 illustrates that the frequency response of a loudspeaker according to various implementations (e.g., loudspeaker 10, 300 or 400) has significantly less variation over a range of frequencies (i.e., the response is smoother) as compared with a conventional loudspeaker without the waveguides described herein.

Figure 6:
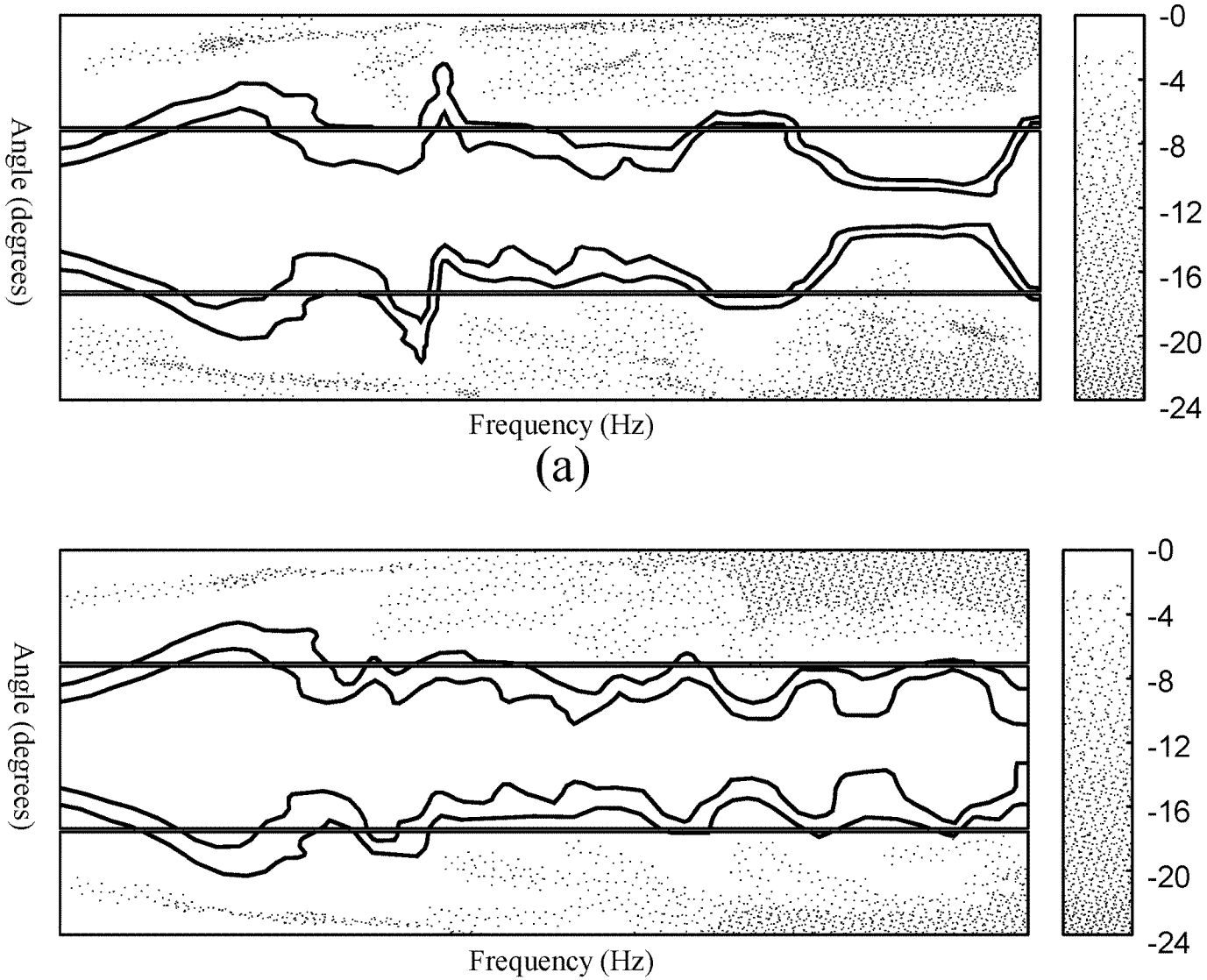
FIG. 6 shows example beamwidth graphs for a conventional loudspeaker and a loudspeaker according to various implementations.

FIG. 6 shows example beamwidth graphs for: (a) a conventional loudspeaker without the waveguide(s) described herein; and (b) the loudspeaker(s) described according to various implementations (e.g., loudspeaker 10, 300 or 400). These graphs illustrate the variation in beamwidth versus frequency for each of the corresponding loudspeakers. As can be seen in this comparison with the conventional loudspeaker in graph (a), the beamwidth between the high frequency and the low frequency is significantly more consistent in graph (b), representing the response for a loudspeaker according to various implementations (e.g., loudspeaker 10, 300 or 400).

In contrast to conventional loudspeakers, loudspeakers 10, 300, and 400 can provide a low-profile (e.g., flush-mounted or surface-mounted) speaker configuration with a consistent off-axis response and a smooth on-axis high-frequency response. For example, in some cases, the loudspeakers described herein can provide an acoustic output comparable to loudspeakers with significantly greater depth.

It is understood that the relative proportions, sizes and shapes of the loudspeakers 100, 300, 400 and components and features thereof as shown in the FIGURES included herein can be merely illustrative of such physical attributes of these components. That is, these proportions, shapes and sizes can be modified according to various implementations to fit a variety of products. For example, while a substantially rectangular-shaped loudspeaker may be shown according to particular implementations, it is understood that the loudspeaker could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A loudspeaker comprising:

a high frequency (HF) driver;

a low frequency (LF) driver coaxially arranged with the HF driver; and a waveguide overlying a sound radiating surface of the LF driver, the waveguide having a hole pattern such that a sound radiation pattern of the LF driver matches a sound radiation pattern of the HF driver at a reference location.

2. The loudspeaker of claim 1, wherein the waveguide comprises an aperture through which the HF driver is exposed, wherein the HF driver is positioned in front of the LF driver, wherein the sound radiation pattern of the HF driver is directed to a front of the loudspeaker, wherein the waveguide directs the sound radiation pattern of the LF driver to the front of the loudspeaker, and wherein the reference location is in front of the loudspeaker.

3. The loudspeaker of claim 1, further comprising batting located between the waveguide and the LF driver, wherein the batting controls cavity resonance between the LF driver and the waveguide, and wherein the batting is acoustically transparent at low frequencies and acts as a rigid acoustic boundary at high frequencies.

4. The loudspeaker of claim 1, wherein the HF driver is positioned in front of the LF driver, wherein the waveguide is located in front of the LF driver and directs the sound radiation pattern of the LF driver to a front of the loudspeaker, and wherein the reference location is in front of the loudspeaker.

5. The loudspeaker of claim 1, wherein the waveguide comprises a rigid baffle surrounding the HF driver and defining the hole pattern.

6. The loudspeaker of claim 5, wherein the hole pattern comprises a plurality of holes arranged around the HF driver.

7. The loudspeaker of claim 1, wherein energy from the LF driver is vented through holes in the hole pattern to control a beamwidth of an acoustic output, wherein the reference location is approximately ten meters in front of the loudspeaker with a lateral distance defined by the beamwidth of the loudspeaker.

8. The loudspeaker of claim 1, wherein the waveguide comprises a material for dissipating heat from the HF driver.

9. The loudspeaker of claim 1, further comprising:

an enclosure defining an acoustic volume in front of the LF driver; and a Helmholtz resonator coupled with the acoustic volume in front of the LF driver.

10. The loudspeaker of claim 1, further comprising:

a housing defining an acoustic backvolume between the LF driver and the HF driver; and a Helmholtz resonator coupled with the acoustic backvolume between the LF driver and the HF driver.

11. A loudspeaker comprising:

a high frequency (HF) driver;

a low frequency (LF) driver coaxially arranged with the HF driver;

a waveguide overlying a sound radiating surface of the LF driver, the waveguide comprising a plate with a plurality of holes extending axially therethrough, wherein a sound radiation pattern of the LF driver matches a sound radiation pattern of the HF driver at a reference location; and batting located between the waveguide and the LF driver, wherein the batting controls cavity resonance between the LF driver and the waveguide.

12. The loudspeaker of claim 11, wherein the waveguide comprises an aperture through which the HF driver is exposed, wherein the HF driver is positioned in front of the LF driver, wherein the sound radiation pattern of the HF driver is directed to a front of the loudspeaker, wherein the waveguide directs the sound radiation pattern of the LF driver to the front of the loudspeaker, and wherein the reference location is in front of the loudspeaker.

13. The loudspeaker of claim 11, wherein the batting is acoustically transparent at low frequencies and acts as a rigid acoustic boundary at high frequencies.

14. The loudspeaker of claim 11, wherein the HF driver is positioned in front of the LF driver, wherein the waveguide is located in front of the LF driver and directs the sound radiation pattern of the LF driver to a front of the loudspeaker, and wherein the reference location is in front of the loudspeaker.

15. The loudspeaker of claim 11, wherein the plate comprises a rigid baffle, and wherein the plurality of holes are arranged around the HF driver.

16. The loudspeaker of claim 11, wherein energy from the LF driver is vented through the plurality of holes to control a beamwidth of an acoustic output, wherein the reference location is approximately ten meters in front of the loudspeaker with a lateral distance defined by the beamwidth of the loudspeaker.

17. The loudspeaker of claim 11, further comprising:

an enclosure defining an acoustic volume in front of the LF driver; and a Helmholtz resonator coupled with the acoustic volume in front of the LF driver.

18. The loudspeaker of claim 11, further comprising:

a housing defining an acoustic backvolume between the LF driver and the HF driver; and a Helmholtz resonator coupled with the acoustic backvolume between the LF driver and the HF driver.

19. A method comprising:

providing a loudspeaker comprising:

a high frequency (HF) driver;

a low frequency (LF) driver coaxially arranged with the HF driver; and a waveguide overlying a sound radiating surface of the LF driver; and converting an electrical signal to an acoustic output at the loudspeaker, wherein the waveguide has a hole pattern such that the acoustic output comprises a sound radiation pattern of the LF driver that matches a sound radiation pattern of the HF driver at a reference location.

20. The method of claim 19, wherein energy from the LF driver is vented through holes in the hole pattern to control a beamwidth of the acoustic output, wherein the loudspeaker further comprises batting located between the waveguide and the LF driver, wherein the batting controls cavity resonance between the LF driver and the waveguide, and the batting is acoustically transparent at low frequencies and acts as a rigid acoustic boundary at high frequencies, wherein the HF driver is positioned in front of the LF driver, wherein the sound radiation pattern of the HF driver is directed to a front of the loudspeaker, wherein the waveguide directs the sound radiation pattern of the LF driver to the front of the loudspeaker, and wherein the reference location is in front of the loudspeaker.

* * * * *